US007004828B1

(12) United States Patent
Picou

(10) Patent No.: US 7,004,828 B1
(45) Date of Patent: Feb. 28, 2006

(54) SANDER APPARATUS AND METHOD

(76) Inventor: Kenneth Picou, 5508 Montview St., Austin, TX (US) 78756

( * ) Notice: Subject to any disclaimer, the term of this patent is extended or adjusted under 35 U.S.C. 154(b) by 0 days.

(21) Appl. No.: 11/003,649

(22) Filed: Dec. 3, 2004

(51) Int. Cl.
*B24B 23/00* (2006.01)

(52) U.S. Cl. ..... 451/358; 451/361

(58) Field of Classification Search ..... 451/361, 451/523, 358, 356, 435, 374–376
See application file for complete search history.

(56) References Cited

U.S. PATENT DOCUMENTS 2,519,542 A * 8/1950 Carey et al. ..... 451/155
2,930,164 A * 3/1960 Metoff ..... 451/155
4,720,940 A 1/1988 Green
5,402,605 A * 4/1995 Paules ..... 451/157
5,421,126 A 6/1995 Strege
5,525,099 A * 6/1996 Baird et al. ..... 451/415
5,980,167 A * 11/1999 Chen ..... 408/87
2004/0058628 A1 * 3/2004 Armstrong ..... 451/237

* cited by examiner

*Primary Examiner*—Dung Van Nguyen
(74) *Attorney, Agent, or Firm*—J. Nevin Shaffer, Jr.

(57) ABSTRACT

A sander apparatus and method includes a sander table and a sanding drum. A guide bearing is connected to the sanding drum wherein the guide bearing is conformed to fit within the stabilizing guide bearing receiver in the sander table.

20 Claims, 9 Drawing Sheets

Fig. 15
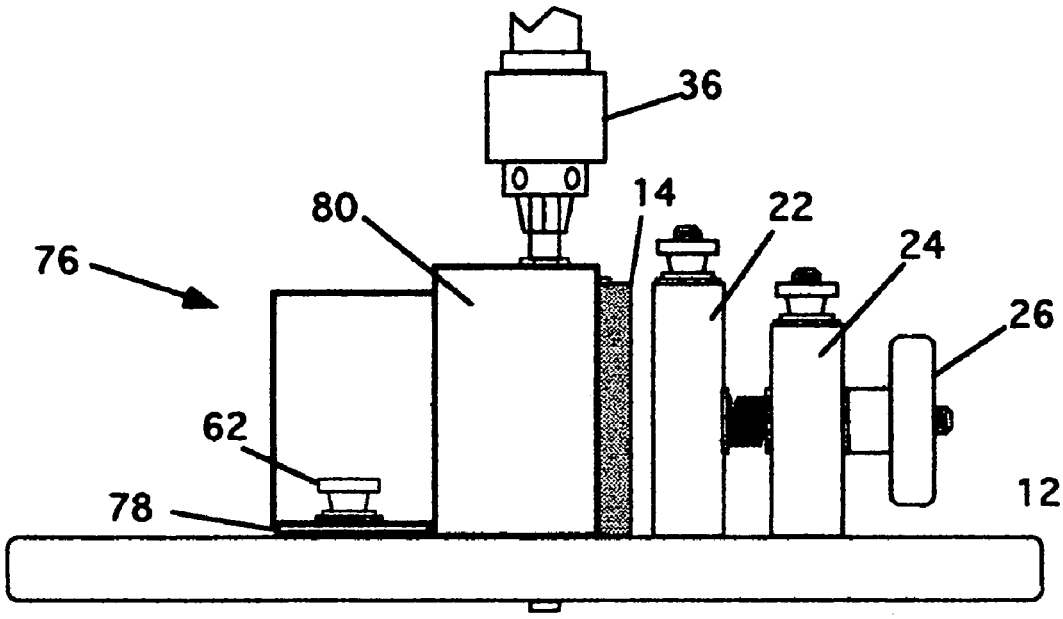
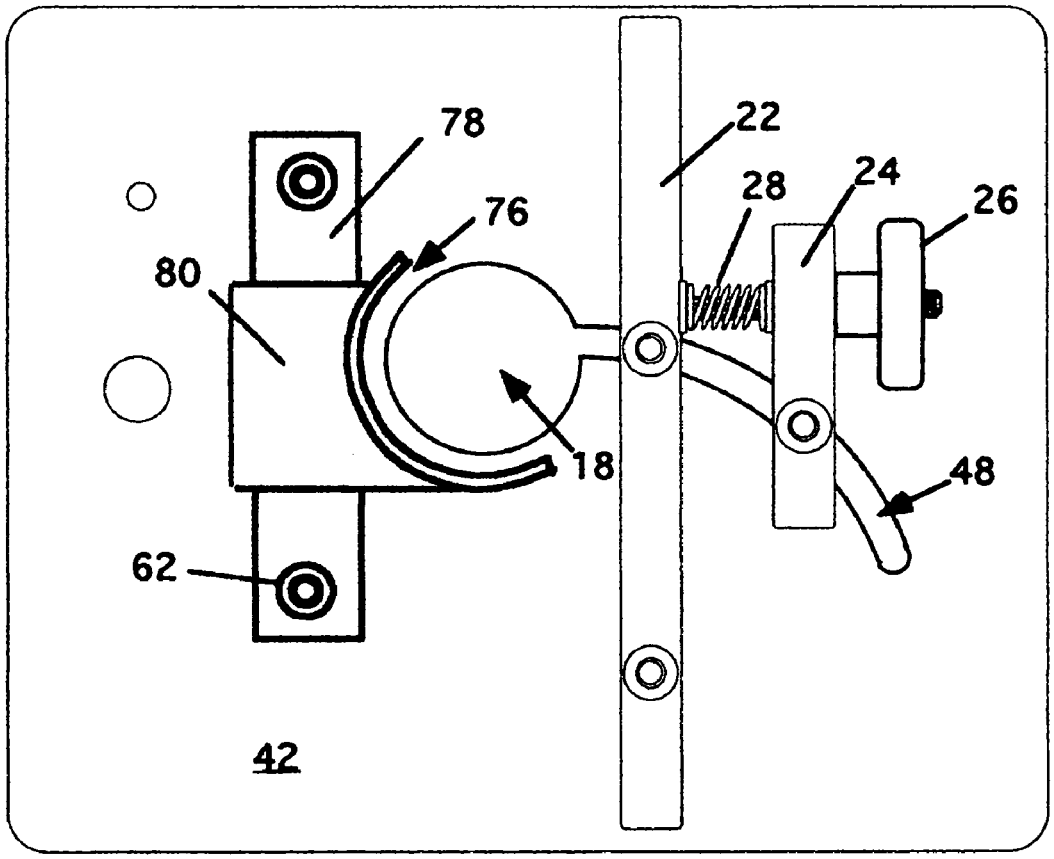
Fig. 16

SANDER APPARATUS AND METHOD

FIELD OF THE INVENTION

This invention relates to a sander apparatus. In particular, according to one embodiment, the invention relates to a sander apparatus including a sander table and a sanding drum. A guide bearing is connected to the sanding drum wherein the guide bearing is conformed to fit within a stabilizing guide bearing receiver in the sander table.

BACKGROUND OF THE INVENTION

A difficulty arises when the necessity of shaping materials is presented. For example only, and not by way of limitation, it is often useful to shape wood by means of sanding machines. While sanding machines are an improvement over hand sanding, sanding machines are currently only available in sizes that are bulky, expensive, and limited in scope to a single operation. Small shops and individuals are left with very expensive options in attempting to mechanize the sanding needs they face. Additionally, the larger sanding machines that are available do not necessarily work well for small-scale sanding jobs.

An additional problem with the sanding mechanisms known in the art concerns the mechanisms for adjusting these prior art sanding machines. Simply put, the prior art adjustment mechanisms are often complex and typically do not allow for very fine adjustments. Additionally, most typically they function in the horizontal plane which requires the adjustment mechanism to overcome its weight and/or the weight of the object being sanded.

Sanding devices known in the art are typified by the rotary drum sander set forth in U.S. Pat. No. 4,720,940 to Green. The Green device requires an involved installation which, once installed, negates the original purpose and use of the tool to which it is attached. Other portable sanding devices exist which are easier to remove but they do not work well because they do not adequately support the material to be surfaced and they are limited in scope as are larger machines. Such a limited device is found in U.S. Pat. No. 5,421,126 to Strege.

In sum, the prior art sanding machines are big machines, complex and expensive and limited in scope typically to a single operation. By way of example only and not by limitation, a drill press is a common tool found in even the smallest of shops. It would be exceedingly useful therefore to enable individuals and small shops that own a drill press is to utilize the drill press as an effective and efficient sander as well.

Thus, there is a need in the art for providing a sander apparatus and method that is easy to install and remove, that is inexpensive, and that is useful in multiple ways without hindering the operation of the machine to which it is attached. It, therefore, is an object of this invention to provide a sander apparatus and method for use with a variety of machines that is easy to use, inexpensive, and which does not detract from the usefulness of the machine to which it is attached.

SUMMARY OF THE INVENTION

The sander apparatus and method, according to an embodiment of the invention, includes a sander table. A sanding drum is provided and a guide bearing is connected to the sanding drum wherein the guide bearing is conformed to fit within a stabilizing guide bearing receiver in the sander table. According to another aspect of this invention, a micro-adjustable fence is movably connected to the sander table. According to another aspect, a sliding vise is provided. According to a further aspect of the invention a fence stop is provided. According to an additional aspect of this invention, a curved component attachment is connected to the micro-adjustable fence. According to a further aspect, a guide pin is connected to the sander table. In accordance with a further aspect, a dust collector is attached to the apparatus.

According to another embodiment of the invention, a sander apparatus includes a sander table connected to a drill press. A vertical sanding drum, with a first end and a second end, is provided wherein the first end is connected to the drill press. A single guide bearing is connected to the second end wherein the single guide bearing is conformed to fit within a stabilizing guide bearing receiver in the sander table. According to another aspect of this invention, a micro-adjustable fence is movably connected to the sander table. According to another aspect, a sliding vise is provided and according to additional aspects of the invention a curved component attachment and a fence stop connected to the micro-adjustable fence are provided. According to another aspect of the invention, a guide pin is connected to the sander table. According to a further aspect, a dust collector is provided.

In accordance with another embodiment of the invention, in a drill press, a sander apparatus includes a sander table connected to the drill press. A vertical sanding drum, with a first end and a second end, is provided wherein the first end is connected to the drill press. A single guide bearing is connected to the second end wherein the single guide bearing is conformed to fit within a stabilizing guide bearing receiver in the sander table. Finally, a micro-adjustable fence is movably connected to the sander table.

In accordance with a further embodiment of the invention, a method for providing a sander in a drill press includes connecting a sander table to a drill press. A vertical sanding drum is provided. The sanding drum includes a first end and a second end and the first end is connected to the drill press. A single guide bearing is connected to the second end and is conformed to fit within a stabilizing guide bearing receiver in the sander table. According to a further aspect of this invention, a micro-adjustable fence is connected to the sander table. According to another aspect, a sliding vise is placed against the micro-adjustable fence. According to another aspect, a curved component attachment is connected to the sander table. In accordance with another aspect of the invention, the single guide bearing is raised out of the stabilizing guide bearing receiver and is used as a template guide bearing.

DESCRIPTION OF THE DRAWINGS

Other objects, features and advantages of the present invention will become more fully apparent from the following detailed description of the preferred embodiment, the appended claims and the accompanying drawings in which:

FIG. 15 is an elevation view of the sander apparatus with a dust collector attached;

FIG. 16 is a plan view of the sander apparatus with a dust collector attached;

DETAILED DESCRIPTION OF THE INVENTION

Figure 1:
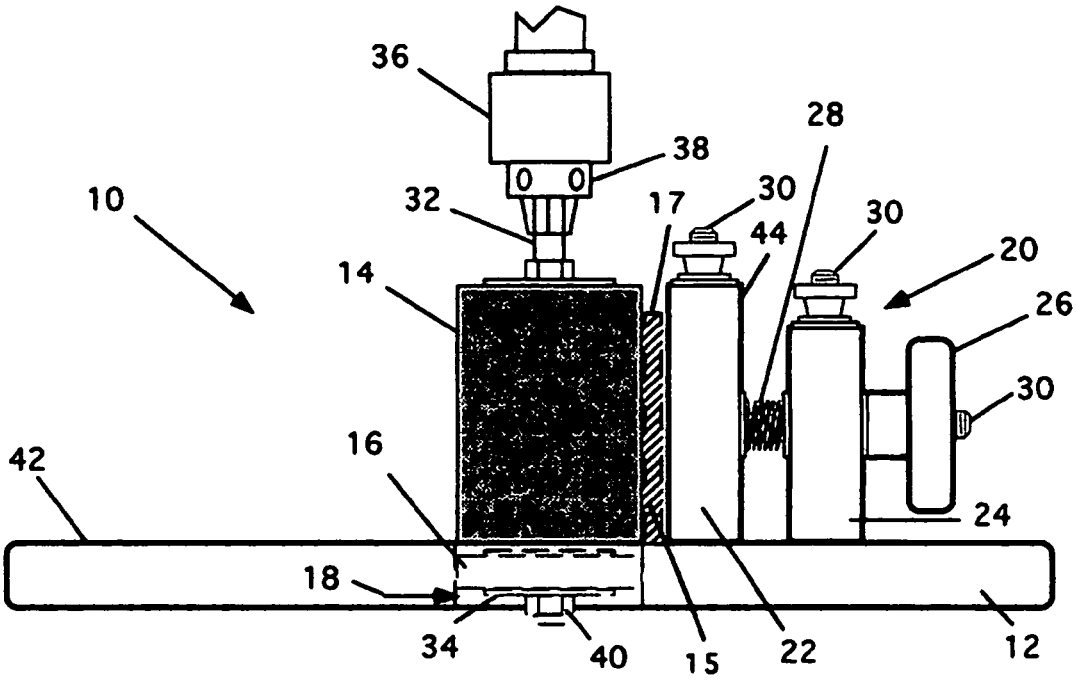
FIG. 1 is an elevation view the of the sander apparatus according to an embodiment of the present invention showing the sanding station with the sanding drum in the down position for thickness sanding.

The sander apparatus of the present invention is illustrated by way of example in FIGS. 1–21. With specific reference to FIGS. 1–3, the sander apparatus 10 according to an embodiment of the present invention includes a sander table 12 and sanding drum 14. Sanding drum 14 includes guide bearing 16. Guide bearing 16 is connected to sanding drum 14. Guide bearing 16 is conformed to fit within stabilizing guide bearing receiver 18 in sander table 12.

FIG. 1 shows sander apparatus 10 in the "down" position. In the "down" position, guide bearing 16 is received within guide bearing receiver 18. By "received", it is intended to mean that the guide bearing 16 snugly fits within guide bearing receiver 18 such that very little side to side motion is tolerated. That is to say, just enough clearance is provided to enable guide bearing 16 to fit within guide bearing receiver 18. By "stabilizing" it is meant that the receiver inhibits run out or wobble in the motive force, a drill press for example only. Deflection of the sanding drum 14 by pressure from the material being sanded 15 is also prevented in the same manner thus insuring that the sanding drum remains exactly perpendicular to the table top 42 and parallel to the vertical face 44 of the main fence 22. Any other source of erratic motion is also prevented by the combination of the Applicant's guide bearing 16 and stabilizing guide bearing receiver 18 so that accurate and consistent sanding may be accomplished each and every time.

FIG. 1 also illustrates micro-adjustable fence 20. Micro-adjustable fence 20 includes, according to one embodiment, main fence 22 and lock block 24.

Micro-adjustable fence 20 also includes micro-adjustor knob 26 and compression spring 28. Main fence 22 as well as lock block 24 are connected to sander table 12 by means of threaded shank connections 30, as will be disclosed and discussed more fully hereafter.

FIG. 1 also illustrates that sanding drum 14 includes a first end 32 and a second end 34. First end 32 is connected to the device selected by the user to provide motive power to the sander apparatus 10. By way of example only and not by limitation, FIG. 1 shows first end 32 of sanding drum 14 connected to a drill press 36. The means for connecting first end 32 of sanding drum 14 to drill press 36 are well-known in the art and are not disclosed or discussed more fully hereafter except to indicate that the sander apparatus and method 10 of the present invention is easy to use. That is to say, all that is required to connect first end 32 to drill press 36, for example only, is to insert the first end 32 into the drill press chuck 38 and tighten the drill press chuck 38 as is known in the art. Obviously, all that is required to remove sander apparatus 10 from drill press 36 is to loosen drill press chuck 38 so as to allow first end 32 to slide out of drill press chuck 38.

Also as illustrated, guide bearing 16 is connected to second end 34. The connection of guide bearing 16 to second end 34 may be by any means now known or hereafter developed including nut 40. FIG. 1 also illustrates sanding drum 14 as the same dimension as guide bearing 16. That is to say, guide bearing 16 has the same radius as sanding drum 14. The outer surface of the sanding drum (14) and the outer edge of the guide wheel (16) align perfectly in the vertical plane. This relationship, as shown in the figures, is maintained even when a sandpaper sleeve or other abrasive surface is provided on sanding drum 14. Sandpaper sleeves, and other abrading devices, cutters and so forth, are well-known in the art and are not disclosed or described more fully hereafter.

Referring still to FIG. 1, what is important to note is that when guide bearing 16 is in the down position and fully received by guide bearing receiver 18 a small portion of sanding drum 14 is also received within guide bearing receiver 18. This ensures that any object to be sanded, such as piece of wood 15, that is placed against sanding drum 14 when resting on the top 42 of sander table 12 will be completely sanded from the top 42 of sander table 12 to the top 17 of the object, such as piece of wood 15, to be sanded.

The use and operation of micro-adjustable fence 20 will be disclosed in discussed more fully hereafter, but, needless to say, it should be obvious that micro-adjustable fence 20 is used to provide a stable platform against which to rest an object to be sanded. In combination, the top 42 of sander table 12 and the vertical face 44 of main fence 22 meet at right angles so that no unintended misalignment is created by the use of main fence 22 and the top 42 of table 12 as a guide. Additionally, as illustrated in the figures, it is important that the vertical face 44 is parallel to the sanding drum 14. Because of the stabilizing guide bearing receiver 18, no unwanted movement of sanding drum 14 is permitted during use of the sander apparatus 10 of the present invention. Equally important, is that sander table 12 is perpendicular to sanding drum 14, all as illustrated.

Figure 2:
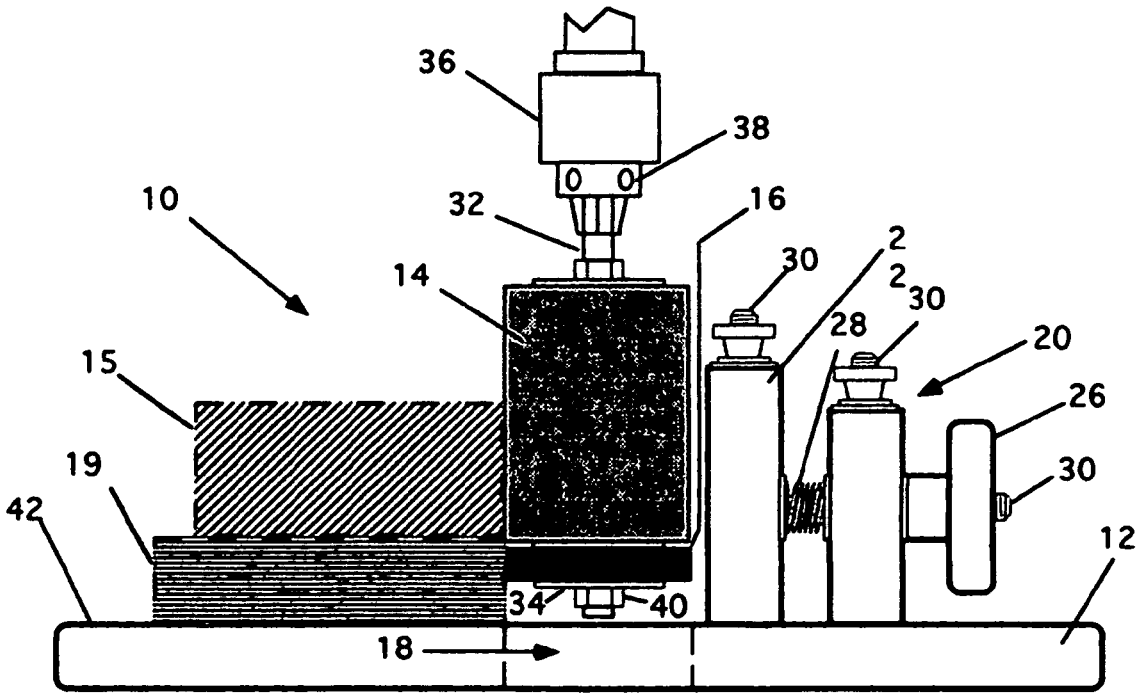
FIG. 2 is an elevation view with the sanding drum in up position for pattern sanding.

Referring now to FIG. 2, the sander apparatus 10 of the present invention is illustrated in the "up" position. In the "up" position, guide bearing 16 is removed from guide bearing receiver 18 in sander table 12. In this position, guide bearing 16 cooperates with any template 19 the user desires that is placed underneath an object be sanded, such as piece of wood 15. The template 19 rides on guide bearing 16 and the object to be sanded is pressed against the sanding drum 14 and an exact duplicate of the template 19 is created.

Figure 3:
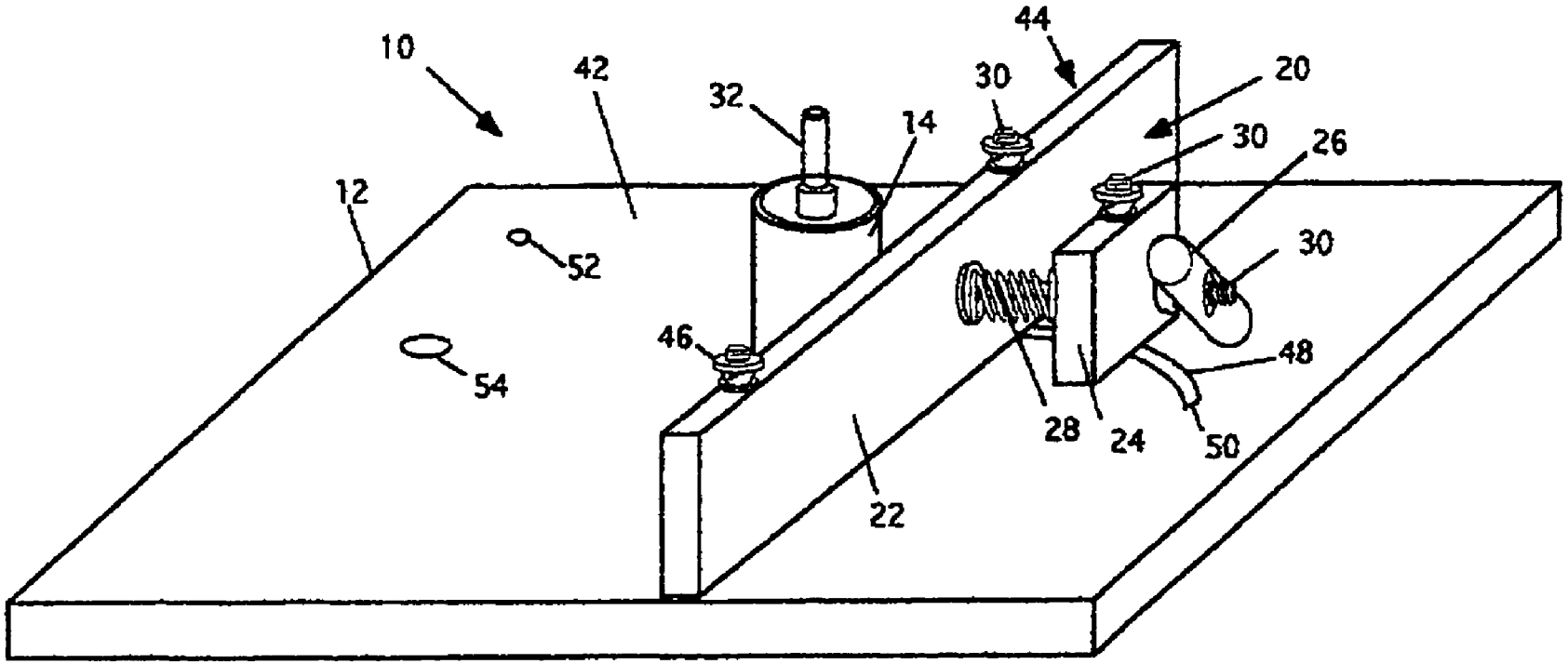
FIG. 3 is a perspective view of an embodiment of the invention according to FIG. 1.

Referring now to FIG. 3, a perspective view of the sander apparatus 10 of the present invention is illustrated. This view clearly illustrates sander table 12 and the location of sanding drum 14 in relation to micro-adjustable fence 20. Micro-adjustable fence 20 includes, as clearly illustrated, main fence 22. Main fence 22 provides a flat surface, vertical face 44 against which an object be sanded is placed. Main fence 22 pivots on pivot post 46. Pivot post 46 is a threaded shank connection 30 and is secured on the bottom of sander table 12 as will be discussed more fully hereafter with reference to FIGS. 4, 5 and 6. Micro-adjustable fence 20 pivots around pivot post 46 within radial track 48. In use, micro-adjustable fence 20 is placed near sanding drum 14 for gross sanding guidance. Thereafter, lock block 24 is used, as will be discussed more fully hereafter, to minutely advance main fence 22 for the final sanding process. Micro-adjustable fence 20 may be rotated to the fully open position at the end 50 of radial track 48 or may be removed altogether when necessary.

FIG. 3 also illustrates sanding drum storing hole 52 and sander table hanging hole 54. Sanding drum storing hole 52 is drilled in the top 42 of sander table 12 and is conformed to receive first end 32 of sanding drum 14 for storage purposes. Additionally, likewise, sander table hanging hole 54 is a hole drilled in the top 42 of sander table 12 so that sander table 12 may be hung from a nail in a user's shop when not in use. Obviously, any other means for storing the various parts of pieces of sander apparatus 10 that are now known or hereafter developed are suitable for the purposes of the invention.

Figure 4:
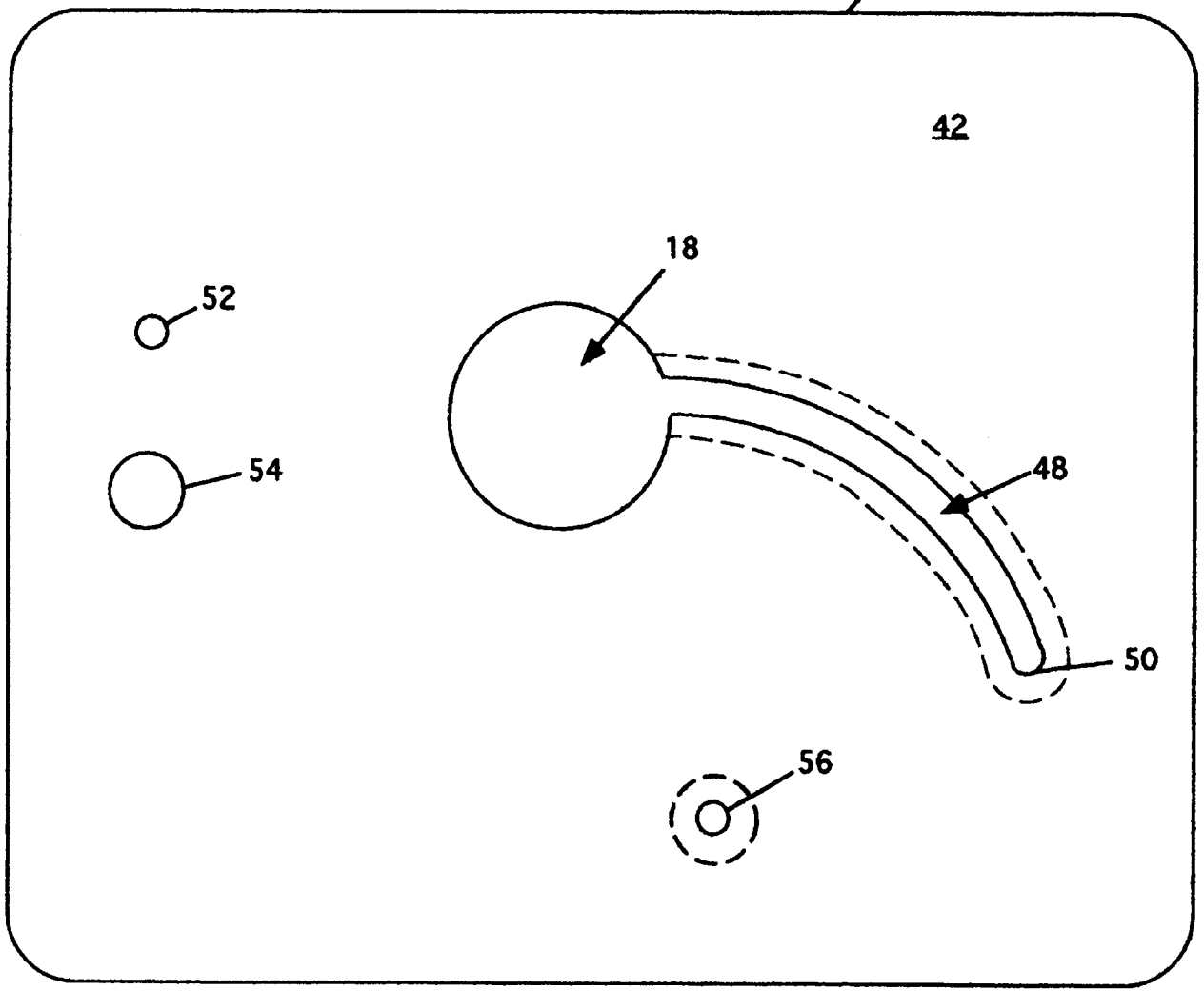
FIG. 4 is a plan view of the sander table according to one embodiment of the invention showing the relative location of holes and slots.

Referring now to FIG. 4, the top 42 of sander table 12 is illustrated with the various cutouts. That is to say, guide bearing receiver recess 18, radial track 48, sanding drum storing hole 52, and sander table hanging hole 54 are illustrated. Additionally, pivot post hole 56 is illustrated. Additionally, recessed areas 58 in the bottom of sander table 12 are illustrated by means of dotted lines. The recessed areas 58 cooperate with various threaded shank connections 30 and sliding feet 60 as further illustrated and as a further described hereafter.

Figure 5:
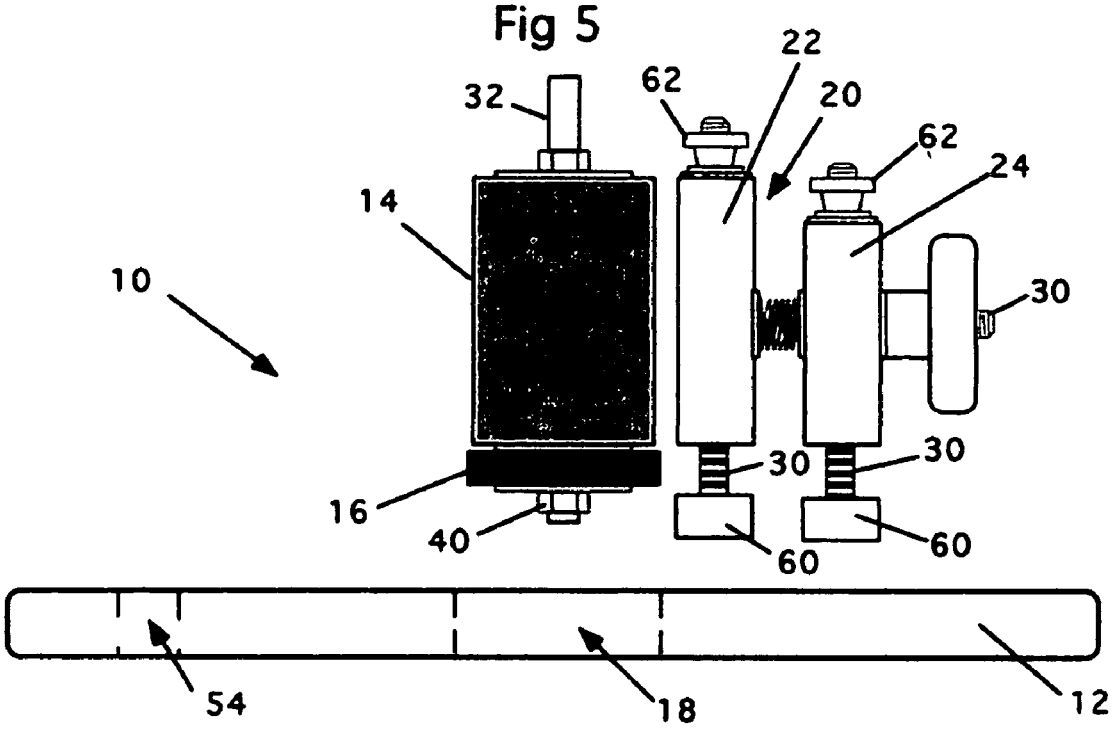
FIG. 5 is an elevation view of the sander apparatus according to one embodiment of the invention.
Figure 6:
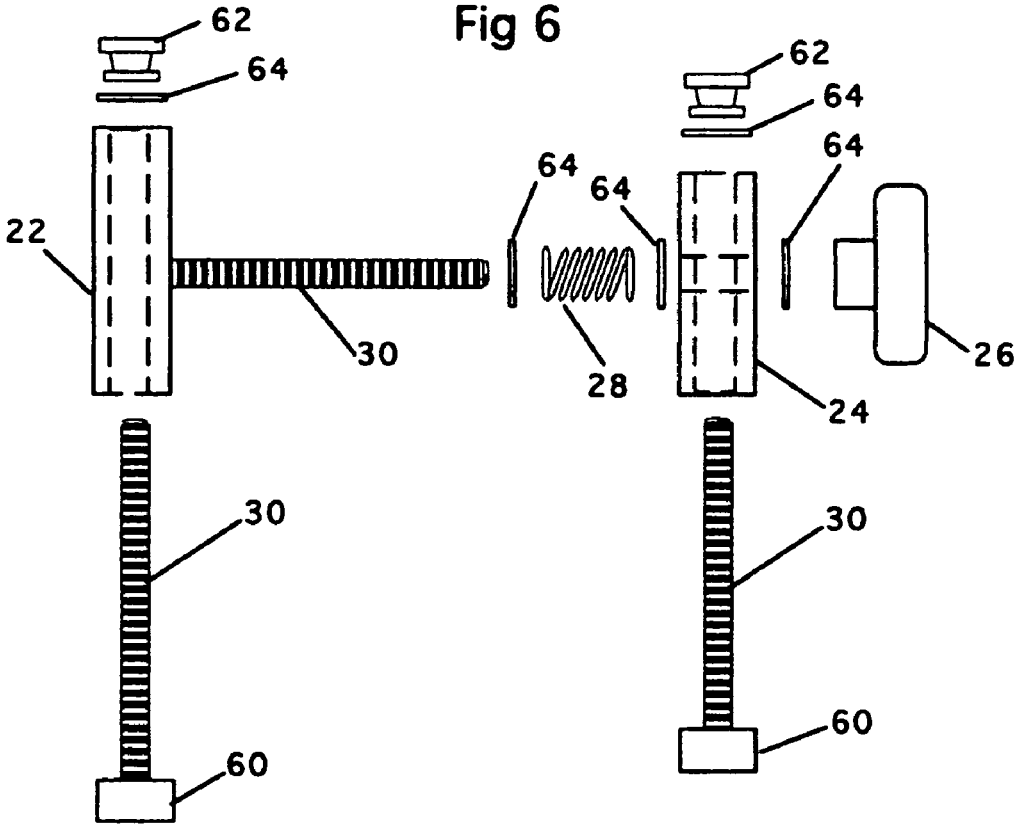
FIG. 6 is an exploded view of a micro-adjustable fence according to one embodiment of the invention.

Referring now to FIG. 5, an elevation view of the sander apparatus 10 of the present invention is illustrated. As can be seen, according to one embodiment, stabilizing guide bearing receiver 18 is a hole completely through sander table 12. This is true also, according to this embodiment, of sanding drum storing hole 52. Also illustrated are the means by which micro-adjustable fence 20 is secured to sander table 12. Again, utilizing threaded shank connections 30, these are passed through main fence 22 and lock block 24, as shown in FIG. 6. The threaded shank connections 30 include, according to one embodiment, sliding foot 60 which fits within recessed area 58 on the bottom of sander table 12. The threaded shank connections 30 are then tightened against the bottom of sander table 12 by means of sliding foot 60 and lock nut 62. Also included are washers 64 as desired and as illustrated.

FIG. 6 illustrates that a threaded shank connection 30 connected to micro-adjuster knob 26 passes horizontally through lock block 24 and compresses compression spring 28 between main fence 22 and lock block 24 when in position. The movement of micro-adjuster knob 26 applies pressure, through compression spring 28 to the back of main fence 22. In use, the gross dimensions necessary for sanding are approximated by the user by moving main fence 22 near the approximate dimension desired. Threaded shank connections 30 by means of lock nuts 62 are secured in place and prevent main fence 22 from moving in the initial sanding operation. Thereafter lock block 24 is maintained secured in place but main fence 22 is allowed to move by loosening of lock nut 62. The movement of micro-adjuster knob 26 incrementally advances the vertical face 44 of main fence 22 so as to enable a user to very accurately sand within very fine limits. Once the incremental advancement of vertical face 44 has been obtained by means of the use of micro-adjuster knob 26, main fence 22 is then re-secured in place so as not to move when used as a guide for sanding.

Figure 7:
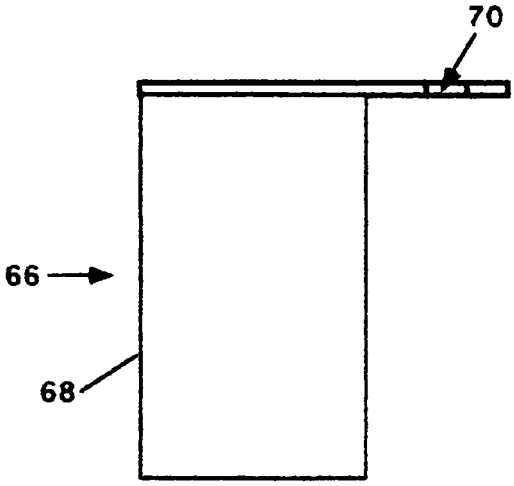
FIG. 7 is an elevation view of a curved component thicknessing attachment according to one embodiment.
Figure 8:
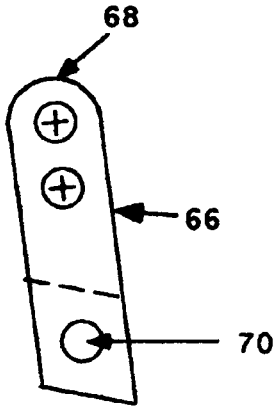
FIG. 8 is a plan view of the curved component thicknessing attachment of FIG. 7.
Figure 9:
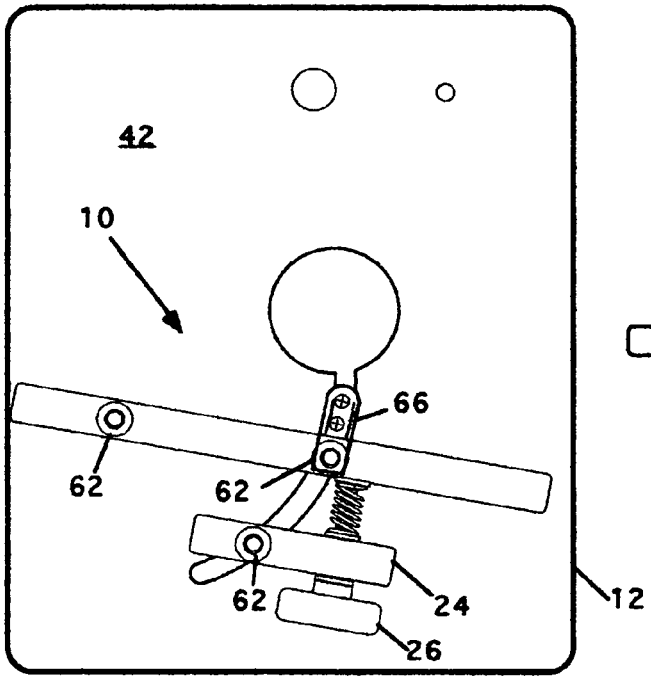
FIG. 9 is a plan view of a sander apparatus with a curved compound thicknessing attachment.
Figure 10:
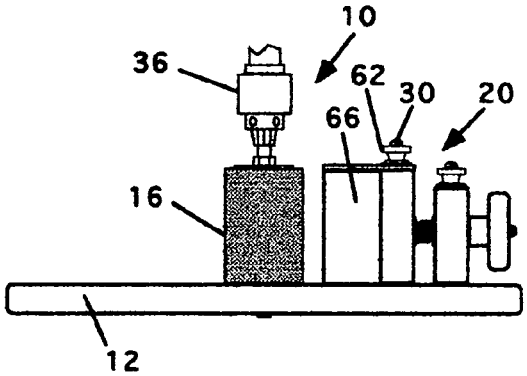
FIG. 10 is an elevation view of the sander apparatus with the curved compound thicknessing attachment of FIG. 7.
Figure 11:
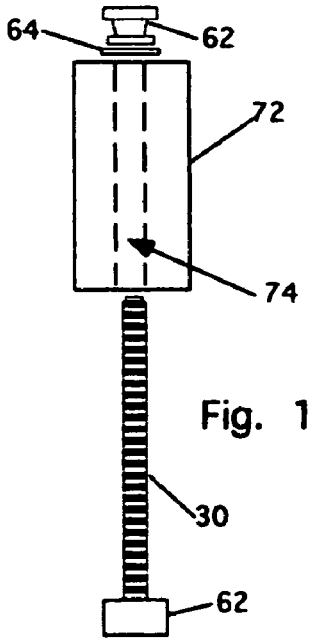
FIG. 11 is an elevation view of a guide pin curved component thicknessing attachment according to another embodiment.
Figure 12:
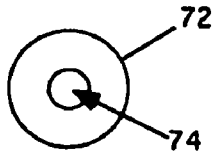
FIG. 12 is a plan view of the guide pin illustrated in FIG. 11.
Figure 13:
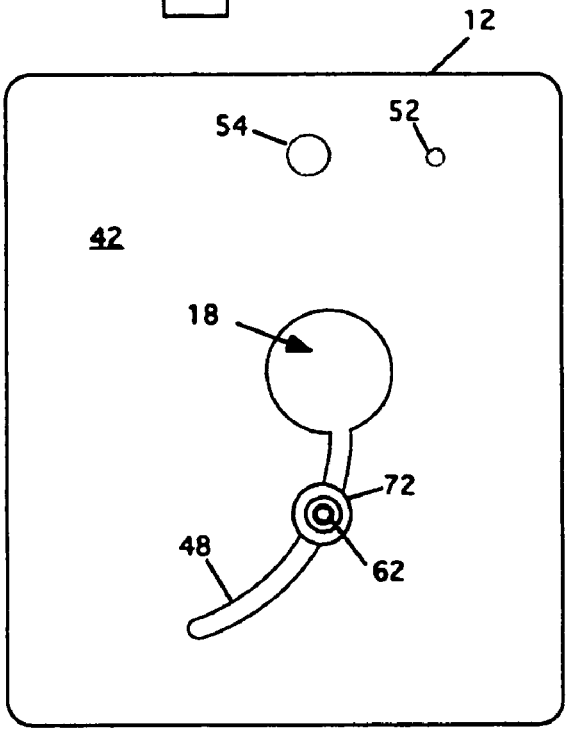
FIG. 13 is a plan view of a sander apparatus with the guide pin curved component thicknessing attachment of FIG. 11.
Figure 14:
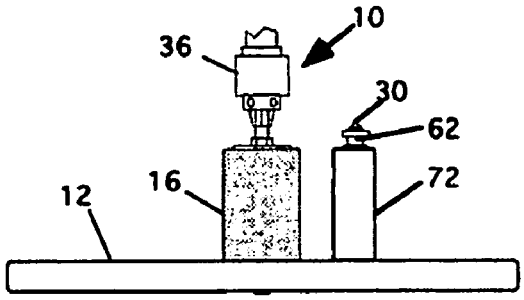
FIG. 14 is an elevation view of the sander apparatus with the alternative guide pin curved component thicknessing attachment.

Referring now to FIGS. 7–9, another aspect of the sander apparatus 10 of the present invention includes curved component attachment 66. Curved component attachment 66 includes work guide 68. In use, curved component attachment 66 is connected to main fence 22 by means of connection hole 70. When placed in position on main fence 22, lock nut 62 is removed and threaded shank connection 30 is passed through connection hole 78. Thereafter, lock nut 62 is screwed back in place and locks main fence 22 in position as previously discussed. As is illustrated, however, curved component attachment 66 provides a single curved resting edge, work guide 68, extended from the vertical face 44 of main fence 22. This provides the clearance from main fence 22 necessary for thicknessing gently curved work pieces. As used herein, the term "thicknessing" is used to mean the process of selectively reducing the thickness of something by sanding it, for example only. Curved component attachment 66 allows the user to utilize the micro-adjustment capabilities of the micro-adjustable fence assembly 20 as discussed above for a curved piece. This ability to provide an extended clearance space is more completely illustrated by the views set forth in FIGS. 9 and 10.

Referring now to FIGS. 11, 12, 13, and 14, another aspect of the invention is disclosed in the form of guide pin 72. Guide pin 72 includes longitudinal hole 74. In use, micro-adjustable fence 20 is removed altogether from sander table 12 (see FIGS. 13 and 14). Thereafter, threaded shank connection 30 is passed up from the bottom of sander table 12 into the recessed part 58 of radial track 48. Thereafter, guide pin 72, cylindrical in form, for example only, is connected to a threaded shank connection 30 by use of longitudinal hole 74. Thereafter, washer 64 and lock nut 62 cooperate to secure guide pin 72 in location where desire. As illustrated, a single cylindrical guide pin 72 is useful for thickness sanding of curved components which are too tightly curved to be used with curved component attachment 66. Again, the micro-adjustable fence 20 is removed from sander apparatus 10 altogether in this aspect of the invention and guide pin 72 is mounted to the sander table 12 as discussed. Guide pin 72 may or may not incorporate bearings and/or ratcheting mechanisms to allow it to rotate upon contact with a work piece.

Referring now to FIGS. 15 and 16, another aspect of the sander apparatus and method 10 of the present invention includes a dust collector 76. Dust collector 76 includes mounting brackets 78 and dust collector shroud 80. As illustrated, mounting brackets 78 are utilized to secure dust collector 76 in position on top 42 of sander table 12. Dust collector shroud 80 partially encompasses sanding drum 14 but does not interfere with the operation of micro-adjustable fence 20 and sanding drum 14 in use. The dust collector shroud 80 is connected to any vacuum source now known or hereafter developed such as a shop vacuum. This connection to the vacuum source is not shown as it is well within the scope of those of ordinary skill in the art. As illustrated, the addition, and removal, of dust collector 76 is easy, quick and simple.

Figure 17:
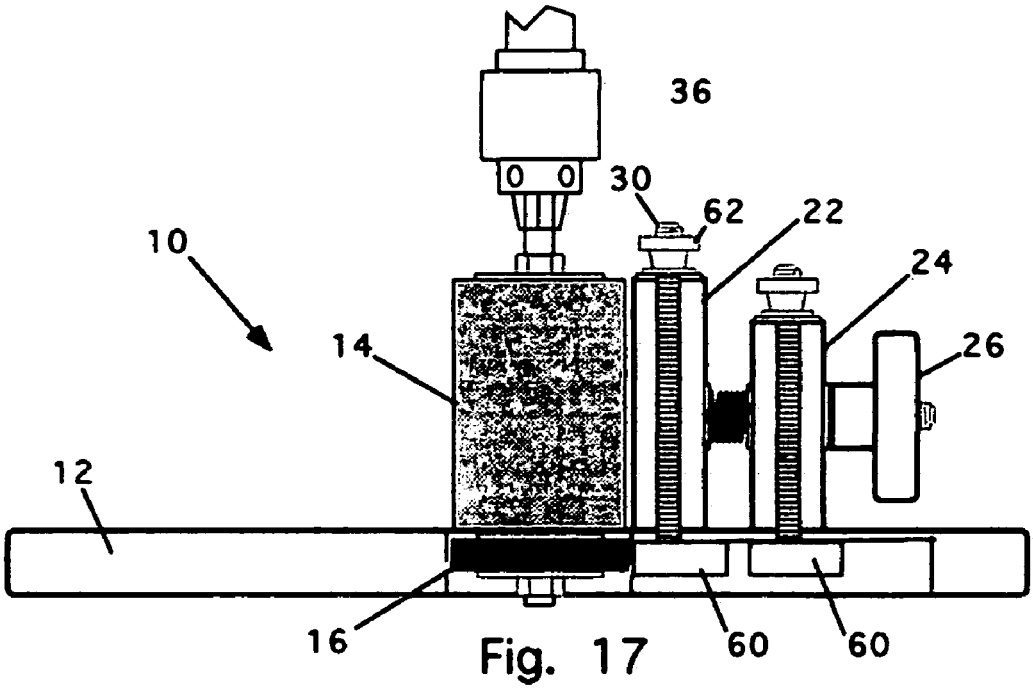
FIG. 17 is a section view of the sander apparatus showing an integral fence stop.
Figure 18:
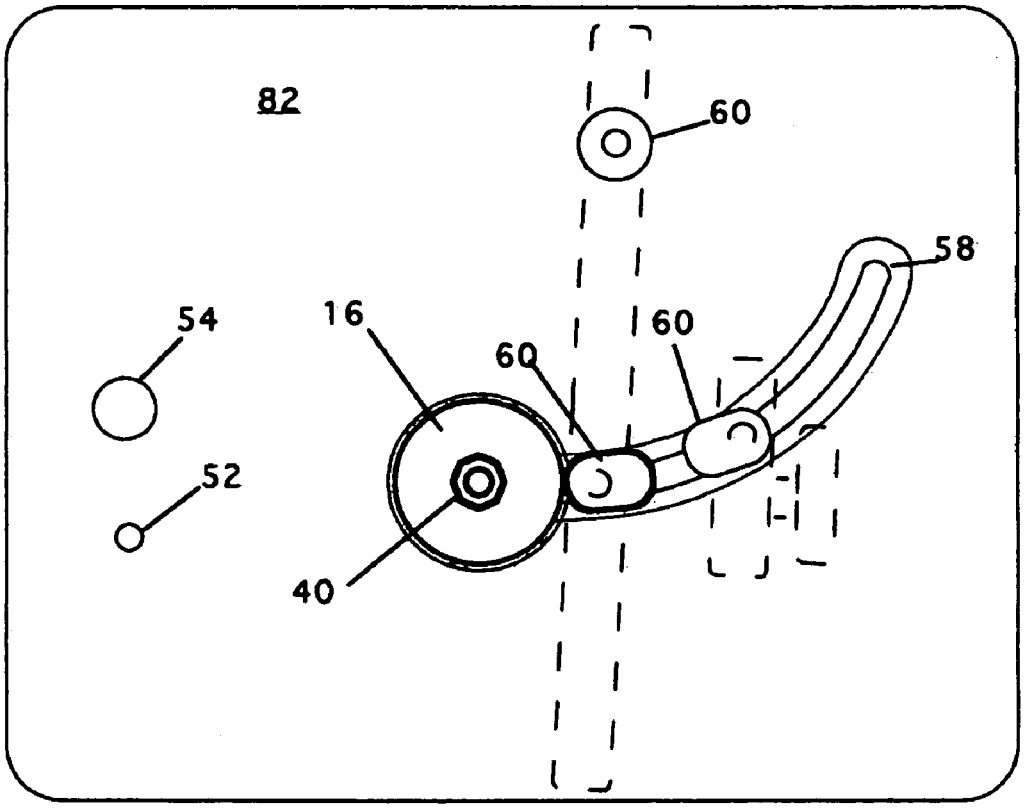
FIG. 18 is a plan view of the bottom of the sander table including the integral fence stop.

Referring now to FIGS. 17 and 18, another aspect of the sander apparatus and method 10 of the present invention is disclosed wherein the sliding foot 60 of the threaded shank connection 30 connected to main fence 22 is sized so as to engage the guide bearing 16 when main fence 22 nears the sanding drum 14. That is to say, according to this aspect of the invention, sliding foot 60 prevents vertical face 44 of main fence 22 from coming in direct contact with sanding drum 14. This is accomplished, again, by the fact that in this aspect sliding foot 60 is of a dimension to contact guide bearing 16 before the vertical face 44 engages sanding drum 14. FIG. 18 shows the bottom 82 of sander table 12 and all the operating parts of this aspect of the invention as discussed with reference to FIG. 17.

Figure 19:
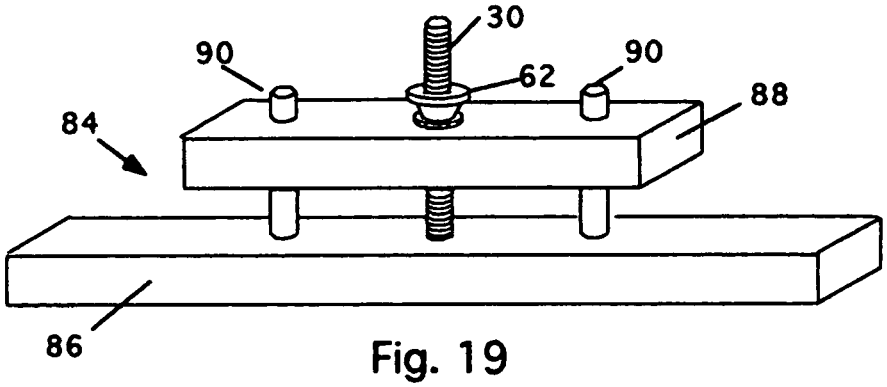
FIG. 19 is a perspective view of a sliding vise according to one embodiment.
Figure 20:
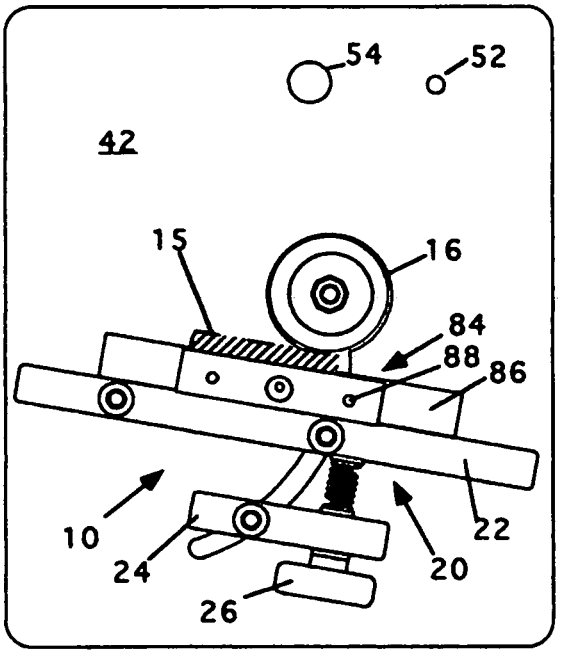
FIG. 20 is a plan view of showing the sliding vise used on the sander table.
Figure 21:
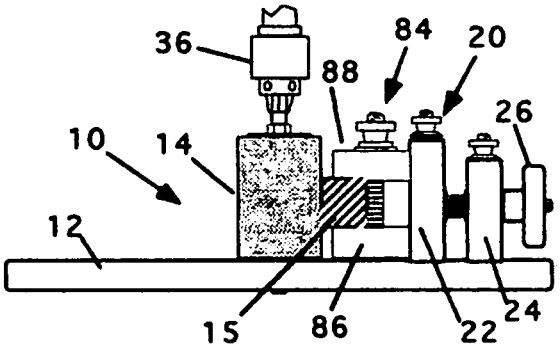
FIG. 21 is an elevation view showing the sliding vise in use with the sander apparatus.

Referring now to FIGS. 19–21, a further aspect of the sander apparatus and method 10 of the present invention is illustrated. According to this aspect of the invention, a sliding vise 84 is provided. Sliding vise 84 includes base 86 and jaw 88. Base 86 and jaw 88 are connected together by means of a threaded shank connector 30 and lock nut 62 as previously discussed. Pin guides 90 maintain jaw 88 in a movable but fixed relation with base 86 as with known devices. Material to be thicknessed, such as a piece of wood 15, for example only, is clamped between base 86 and the jaw 88 and is indexed against pin guides 90. The wide base 86 of sliding vise 84 ensures that the material to be thicknessed is held perpendicular to the sanding drum 14 and parallel to the vertical face 44 of main fence 22. The length of the base 86, as illustrated, enables the user to advance the sliding vise 84 without endangering the hands of the user. If necessary, a shim or spacer held against pin guides 90 can be used to properly place material that is too thin to be indexed against pin guides 90 themselves. Otherwise, once the material is properly secured within sliding vise 84 sander apparatus and method 10 of the present invention is utilized as previously described to accomplish safe and efficient thicknessing of any desired material.

The ease of operation of the sander apparatus and method 10 of the present invention is more fully understood by the following discussion. The simple setup requires the insertion of first end 32 of sanding drum 14 into the machine chosen to provide a rotational motive power, such as a drill press, for example only. The first end 32 is inserted into drill press chuck 38 and secured as is known. Thereafter sander table 12 is mounted loosely to a drill press support table (not shown) using either external clamps or mounting posts, for example only. The drill press table, as is known in the art, is movable and is raised to a height where the bottom of the guide bearing 16 is slightly above the top 42 of sander table 12. Thereafter sanding drum 14 and sander table 12 are aligned by lowering sanding drum 14 so that the guide bearing 16 fits in the guide bearing receiver 18 in sander table 12. This ensures perfect alignment regardless of sander table 12 orientation. At that point, sander table 12 is locked into position by any means now known or hereafter developed. Sander apparatus and method 10 of the present invention is now ready for use.

For thickness standing, sander drum 14 is lowered into sander table 12 such that guide bearing 16 is received within guide bearing receiver 18. Also, a small portion of the lower edge of sanding drum 14 is lowered into the receiver 18. This ensures, again, that sanding drum 14 presents a perfectly flat surface to any object to be thicknessed. At that point, the drill press quill is locked in the down position, as is known in the art. If there is no locking mechanism on the drill press it may be locked in position through the use of a shim or hose clamp, or the drill press table may simply be raised to the proper height.

Thereafter, the micro-adjustable fence 20 is positioned so that the minimum distance from the vertical face 44 of main fence 22 and the sanding drum 14 is within a short distance of the final desired thickness, for example an eighth of an inch. Next, the micro-adjustable fence 20 is locked in position as discussed above including locking main fence 22 and lock block 24. Pivot post 46 is also locked into position. At this point, the drill press 36 is turned on. The user should make sure that the rotation of the sanding drum 14 and, hence, the rotation of the abrasive surface is opposing the feed of the material being thicknessed. Next, the surface to be thicknessed is held in a vertical position with the lower edge of the surface on the top 42 of sander table 12 and the surface opposite the surface to be thicknessed resting on the vertical face 44 of main fence 22.

The material to be thicknessed is fed slowly and steadily by hand between the spinning sanding drum 14 and the main fence 22. The abrading surface of the sanding sleeve (not shown) reduces the material to the set thickness. A small push stick can be used to push the material completely through the sander apparatus. To micro-adjust the main fence 22, the lock nut 62 on the main fence 22 is loosened. This releases the main fence 22 to move. The locknut 62 on the lock block 24, however, remains in its fixed and tightened position. At that point, the micro-adjuster knob 26 is turned so as to allow the compression spring 28 to push the vertical face 44 of main fence 22 forward the desired distance. The threads, for example only, provide the ability to micro adjust the device. This distance can be calculated mathematically using the number of threads per inch on the threaded shank connections 30 or may simply be measured. Thereafter, the main fence 22 is locked back into the new position by tightening the locknut 62. The sanding process is repeated until the desired final dimension is reached.

Material can also be sanded to a precise shape by attaching a template 19, or a pattern, to the underside of the material. Once this is done, this combined template 19 and material is then placed on the sander table 12 so that the template rests flat on the top 42 of sander table 12. The sanding drum 14 is then raised to a position so that the guide bearing 16 is that the proper height to make contact with just the template 19 and the abrasive sleeve (not shown) on sanding drum 14 is in full contact with the material to be shaped. In many cases, the micro-adjustable fence 20 may be placed in the full open position so as not to interfere with the shaping of the material. If it appears that there will be a problem with the micro-adjustable fence 20, it can be totally removed allowing use of the full area of the top 42 of sander table 12. The drill press 36 is turned on and the material to be shaped is abraded with a smooth and steady feed to the point where the template 19 comes in contact with the template guide bearing 16 at which point the abrasive process stops.

Freehand sanding may be accomplished by lowering guide bearing 16 into stabilizing guide bearing receiver 18 so that the guide bearing 16 sits below the surface 42 of sander table 12 as discussed above. It is important to note that in this position, as in the thickness sanding application, the guide bearing 16 becomes a lower support bearing for the sanding drum 14. That is to say, the guide bearing 16 enables a user to apply a significant amount of pressure in the sanding process without deflecting the sanding drum 14 or harming the drill press quill or other operational device. This unique feature of Applicant's sander apparatus and method, wherein guide bearing 16 serves as a lower support bearing, ensures accurate, precise, and professional results here-to-for unobtainable in an inexpensive and easy to use sander apparatus.

While the present invention has been disclosed in connection with the preferred embodiment thereof, it should be understood that there may be other embodiments which fall within the spirit and scope of the invention as defined by the following claims.

What is claimed is:

1. A sander apparatus comprising:

a) a sander table;

b) a sanding drum; and c) a guide bearing connected to said sanding drum wherein said guide bearing is conformed to just fit within a stabilizing guide bearing receiver in said sander table so as to prevent side to side motion.

2. The apparatus of claim 1 further comprising a micro-adjustable fence moveably connected to said sander table.

3. The apparatus of claim 2 further comprising a fence stop.

4. The apparatus of claim 2 further comprising a curved component attachment connected to said micro-adjustable fence.

5. The apparatus of claim 1 further comprising a sliding vise.

6. The apparatus of claim 1 further comprising a guide pin connected to said sander table.

7. The apparatus of claim 1 further comprising a dust collector.

8. In a drill press, a sander apparatus comprising:

a) a sander table;

b) a vertical sanding drum with a first end and a second end wherein said first end is connected to said drill press; and c) a single guide bearing connected to said second end wherein said single guide bearing is conformed to just fit within a stabilizing guide bearing receiver in said sander table so as to prevent side to side motion.

9. The apparatus of claim 8 further comprising a micro-adjustable fence moveably connected to said sander table.

10. The apparatus of claim 8 further comprising a sliding vise.

11. The apparatus of claim 8 further comprising a curved component attachment.

12. The apparatus of claim 8 further comprising a fence stop.

13. The apparatus of claim 8 further comprising a guide pin connected to said sander table.

14. The apparatus of claim 8 further comprising a dust collector.

15. In a drill press, a sander apparatus comprising:

a) a sander table connected to a drill press;

b) a vertical sanding drum with a first end and a second end wherein said first end is connected to said drill press;

c) a single guide bearing connected to said second end wherein said single guide bearing is conformed to just fit within a stabilizing guide bearing receiver in said sander table so as to prevent side to side motion; and d) a micro-adjustable fence moveably connected to said sander table.

16. A method of providing a sander in a drill press, the method comprising:

a) connecting a sander table to a drill press;

b) providing a vertical sanding drum, with a first end and a second end, and connecting said first end to said drill press; and c) connecting a single guide bearing to said second end and conforming said single guide bearing to just fit within a stabilizing guide bearing receiver in said sander table so as to prevent side to side motion.

17. The method of claim 16 further comprising the step of connecting a micro-adjustable fence to said sander table.

18. The method of claim 17 further comprising the step of placing a sliding vise against said micro-adjustable fence.

19. The method of claim 16 further comprising the step of connecting a curved component attachment to said sander table.

20. The method of claim 16 further comprising the step of raising the single guide bearing out of said guide bearing receiver and using the single guide bearing as a template guide bearing.

* * * * *